US007603949B2

(12) United States Patent
Yuan et al.

(10) Patent No.: US 7,603,949 B2
(45) Date of Patent: Oct. 20, 2009

(54) SCREEN PRINTING DEVICE WITH INK CONTROL

(75) Inventors: Xiao-Bo Yuan, Shenzhen (CN); Jun Dai, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/168,917

(22) Filed: Jul. 8, 2008

(65) Prior Publication Data

US 2009/0217829 A1 Sep. 3, 2009

(30) Foreign Application Priority Data

Feb. 28, 2008 (CN) ..... 2008 1 0300414

(51) Int. Cl.
*B41F 15/44* (2006.01)
*B41F 15/46* (2006.01)

(52) U.S. Cl. ..... 101/123; 101/114; 101/364

(58) Field of Classification Search ..... 101/123, 101/114, 119, 120, 124, 364; *B41F 15/42, B41F 15/44, 15/46*
See application file for complete search history.

(56) References Cited

U.S. PATENT DOCUMENTS

| | | | | |
|---|---|---|---|---|
| 3,252,411 | A * | 5/1966 | Black | 101/124 |
| 5,287,806 | A * | 2/1994 | Nanzai | 101/123 |
| 5,640,907 | A * | 6/1997 | Tani et al. | 101/366 |
| 2004/0069165 | A1 * | 4/2004 | Murakami et al. | 101/123 |

FOREIGN PATENT DOCUMENTS

DE 3115399 A1 * 4/1982

* cited by examiner

*Primary Examiner*—Leslie J Evanisko
(74) *Attorney, Agent, or Firm*—Zhigang Ma

(57) ABSTRACT

An exemplary screen printing device includes a blade, a rotatable connecting element, a lower baffle, and an adjusting element. The rotatable connecting element is fixed to the blade. The lower baffle rotatably connects with the rotatable connecting element. The lower baffle and the blade cooperatively define a chamber for receiving ink therebetween. The adjusting element is connected to the rotatable connecting element. The adjusting element is capable of making the lower baffle rotate thereby opening a bottom of the chamber.

10 Claims, 4 Drawing Sheets

SCREEN PRINTING DEVICE WITH INK CONTROL

BACKGROUND OF THE INVENTION

1. Field of the Invention

The present invention generally relates to screen printing devices, and particularly to a screen printing device with an adjusting element for controlling the flow of ink.

2. Discussion of the Related Art

Generally, a screen printing device includes a printing screen and a blade on the printing screen. The printing screen includes a first portion where a plurality of predetermined patterns are defined, and a second portion where no patterns are defined. In printing, the printing screen is positioned on an article for printing, and ink is placed on the printing screen. The blade moves along the printing screen from one end to the other end, such that the ink is driven through the first portions of the printing screen by the blade and applied on the article. Thus, a plurality of images is formed on the article corresponding to the predetermined patterns of the printing screen.

Typically, to ensure that the ink covers the first portion of the printing screen completely, the ink should also be placed the second portion of the printing screen. As a result, the ink on the second portion of the printing screen is liable to be wasted. In addition, unused ink on the second portion of the printing screen is not easily cleaned out.

What is needed, therefore, is a new screen printing device that can overcome the above-mentioned shortcomings.

SUMMARY

A screen printing device includes a blade, a rotatable connecting element, a lower baffle, and an adjusting element. The rotatable connecting element is fixed to the blade. The lower baffle rotatably connects with the rotatable connecting element. The lower baffle and the blade cooperatively define a chamber for receiving ink therebetween. The adjusting element is connected to the rotatable connecting element. The adjusting element is capable of making the lower baffle rotate thereby opening a bottom of the chamber.

Other novel features and advantages will become more apparent from the following detailed description, when taken in conjunction with the accompanying drawings.

BRIEF DESCRIPTION OF THE DRAWINGS

The components in the drawings are not necessarily drawn to scale, the emphasis instead being placed upon clearly illustrating the principles of the present screen printing device. Moreover, in the drawings, like reference numerals designate corresponding parts throughout several views, and all the views are schematic.

DETAILED DESCRIPTION OF THE EMBODIMENTS

Reference will now be made to the drawings to describe various exemplary embodiments of the present screen printing device in detail.

Figure 1:
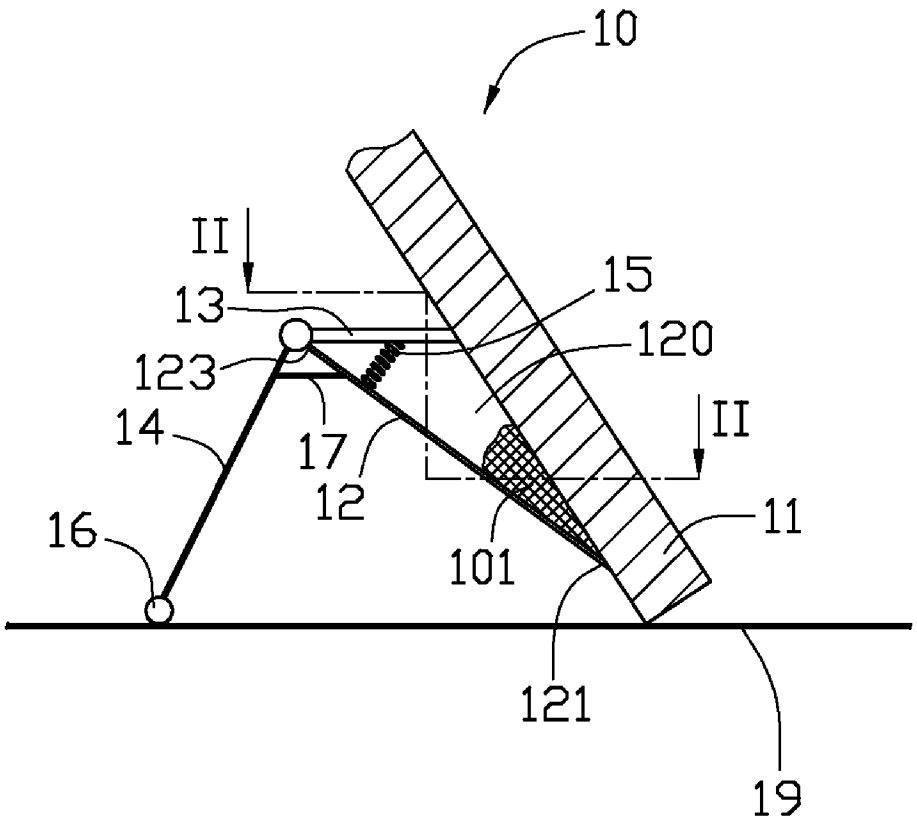
FIG. 1 is a side, cross-sectional view of a screen printing device in accordance with a first preferred embodiment of the present invention.
Figure 2:
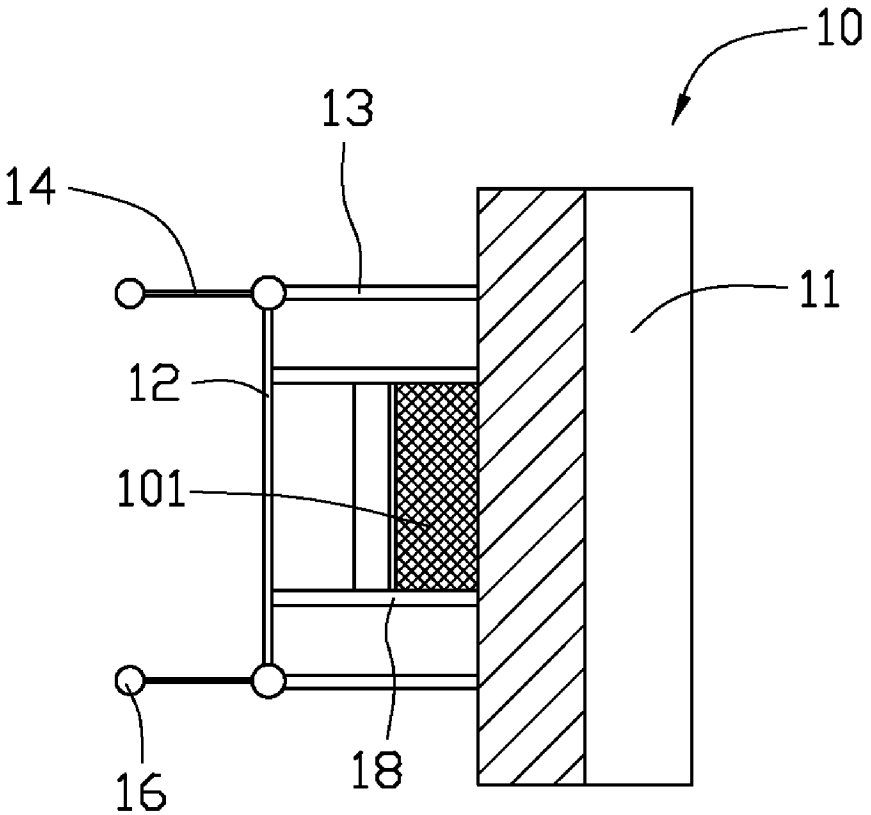
FIG. 2 is a side, cross-sectional view of the screen printing device of FIG. 1, taken along line II-II thereof.

Referring to FIGS. 1 and 2, a screen printing device 10 according to a first preferred embodiment is shown. The screen printing device 10 includes a printing screen 19, a blade 11, a lower baffle 12, two rotatable connecting elements 13, two adjusting elements 14, two elastic elements 15, two sliding elements 16, two reinforcing elements 17, and two side baffles 18.

The printing screen 19 defines a plurality of predetermined patterns according to a desired image to be printed on an article. The lower baffle 12 is substantially rectangular, and has a lower end 121 and an upper end 123. Each rotatable connecting element 13 is substantially a shaft in shape. One end of each rotatable connecting element 13 is fixed to the blade 11, and the other end of each rotatable connecting element 13 is rotatably connected to the lower baffle 12. Each adjusting element 14 is substantially a shaft in shape. Each adjusting element 14 is fixed to the upper end 123 of the lower baffle 12. The elastic elements 15 connect and resist between the lower baffle 12 and the rotatable connecting elements 13. A lower end 121 of the lower baffle 12 is in contact with the blade 11 by forces produced by the elastic elements 15, thus driving the lower baffle 12 close to the rotatable connecting elements 13. In this embodiment, each elastic element 15 is a spring. In an alternative embodiment, each elastic element 15 is an elastic band.

In addition, the two sliding elements 16 are configured on ends of the adjusting elements 14 correspondingly. The sliding elements 16 are used to contact with the printing screen 19. In this embodiment, each sliding element 16 is a pellet. The pellet may be made of durable material, such a marble. In an alternative embodiment, each sliding element 16 is a bearing. The reinforcing elements 17 are configured for enhancing a connection strength between the lower baffle 12 and the adjusting elements 14. Each reinforcing element 17 connects the lower baffle 12 with one of the adjusting elements 14. Each side baffle 18 is substantially triangular. The side baffles 18 are spaced apart between the blade 11 and the lower baffle 12. The side baffles 18 may be fixed in latching grooves (not shown) configured in the blade 11. The blade 11, the lower baffle 12 and the side baffles 18 cooperatively define a chamber 120 for receiving ink 101.

Figure 3:
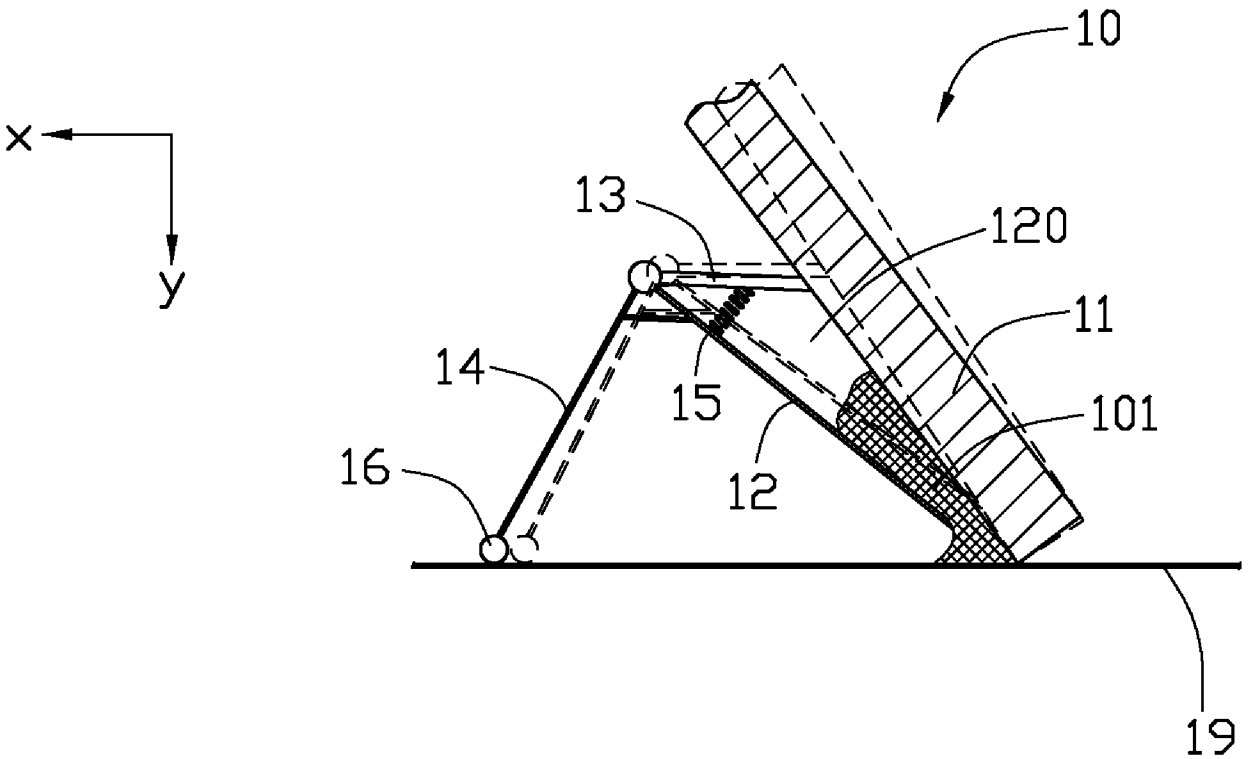
FIG. 3 is similar to FIG. 1, but showing the screen printing device in use.

Referring also to FIG. 3, in use, the ink 101 is poured into the chamber 120 of the screen printing device 10. Then an external force is applied on the blade 11 such that the blade 11 moves along an X direction and generates a force along a Y direction. The force transfers to the adjusting elements 14 via the rotatable connecting elements 13, and then acts on the sliding elements 16 to drive the sliding elements 16 to slide along the printing screen 19. When the sliding elements 16 slide, they drive the lower baffle 12 to rotate via the adjusting elements 14. As shown in FIG. 3, the lower baffle 12 and the adjusting elements 14 start to rotate from the dashed line. Consequently, the elastic elements 15 become elongated, and the first end 121 of the lower baffle 12 separates from the blade 11, thereby opening a bottom of the chamber 120. The ink 101 flows out from the bottom of the chamber 120 onto the printing screen 19. When the blade 11 moves along the X direction, the blade 11 forces the ink 101 on the printing screen 19 through the predetermined patterns of the printing screen 19 onto the article. After the blade 11 moves across the printing screen 19 and/or the external force applied on the blade 11 is released, accumulative elastic forces generated by the elongated elastic elements 15 draw back the lower baffle 12 and the adjusting elements 14 close to the rotatable connecting elements 13. Therefore, the lower end 121 of the lower baffle 12 comes into contact with the blade 11 again, and the ink 101 stops flowing out from the bottom of the chamber 120.

In the screen printing device 10, the ink 101 is not directly applied on the printing screen 19 before printing; but instead is received in the chamber 120 and discharged on the printing screen 19 while printing, on an as-needed basis. Therefore, the use of the ink 101 can be easily regulated. For example, when the blade 11 moves to a portion of the printing screen 19 where no patterns are formed, the external force applied on the blade 11 can be released to stop the ink 101 from flowing out from the bottom of the chamber 120. Thus, using the screen printing device 10 can conserve the amount of the ink 101 used in printing, compared to using a conventional screen printing device. Furthermore, the screen printing device 10 avoids unused ink 101 being left on the printing screen 19 and then being wasted.

It should be understood that the side baffles 18 may be fixed between the blade 11 and the lower baffle 12 by a plurality of latching grooves configured on the blade 11 or the lower baffle 12. Furthermore, the size of the chamber 120 can be easily adjusted by positioning the two side baffles 18 in two selected latching grooves among the different latching grooves.

Figure 4:
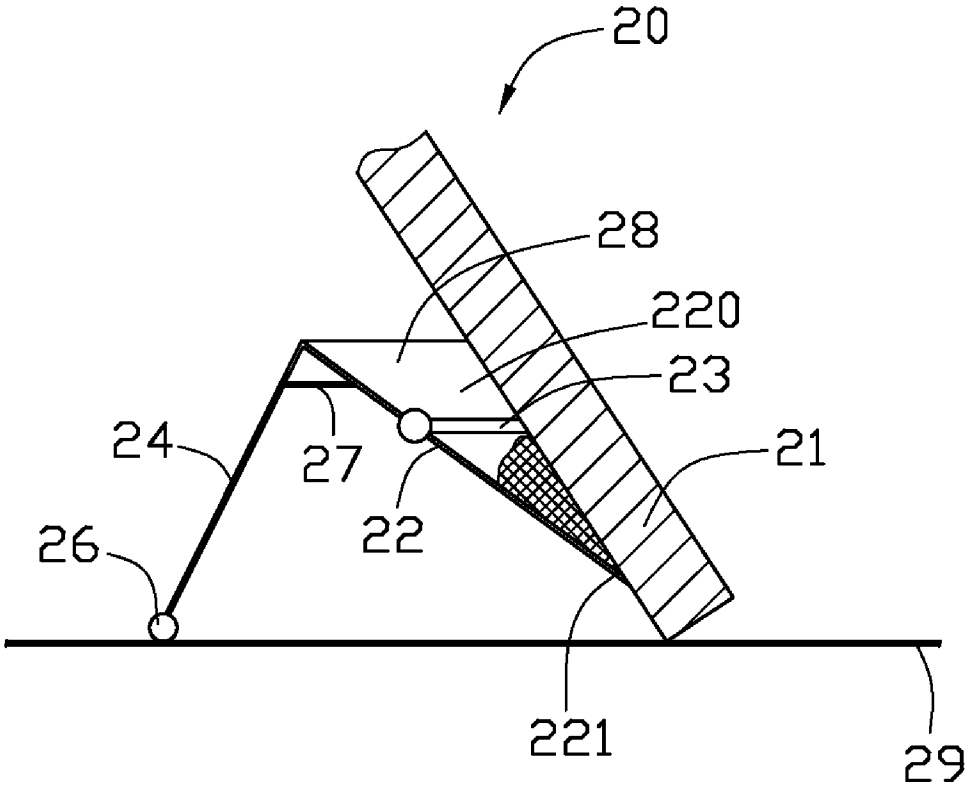
FIG. 4 is a side, cross-sectional view of a screen printing device in accordance with a second preferred embodiment of the present invention.

Referring to FIG. 4, a screen printing device 20 in accordance with a second preferred embodiment of the present invention is shown. The screen printing device 20 includes a printing screen 29, a blade 21, a lower baffle 22, a rotatable connecting element 23, an adjusting element 24, a sliding element 26, a reinforcing element 27, and two side baffles 28. The screen printing device 20 is similar in principle to the screen printing device 10 of the first embodiment. However, the rotatable connecting element 23 is rotatably connected to the lower baffle 22 at a middle portion of the lower baffle 22. The blade 21, the lower baffle 22 and the side baffles 28 cooperatively define a chamber 220. A lower end 221 of the lower baffle 22 is in contact with the blade 11, due to the effect of the gravity acting on the lower baffle 22, the adjusting element 24, the reinforcing element 27, and the side baffles 28.

It should be noted that the scope of the present screen printing device is not limited to the embodiments described above. For example, in the screen printing device 10, the blade 11 may be made of aluminum and silica gel. More particularly, an upper portion of the blade 11 can be made of aluminum, and a lower portion of the blade 11 can be made of silica gel. The sliding elements 16 and the reinforcing elements 17 may be omitted. When the lower baffle 12 defines a recess therein facing the blade 11, the side baffles 18 may also be omitted.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A screen printing device comprising:

a blade;

a rotatable connecting element fixed to the blade;

a lower baffle connecting with the rotatable connecting element and rotatable relative to the rotatable connecting element, the lower baffle and the blade cooperatively defining a chamber therebetween for receiving ink; and an adjusting element connected to the rotatable connecting element, the adjusting element being capable of making the lower baffle rotate thereby opening a bottom of the chamber.

2. The screen printing device of claim 1, wherein the screen printing device further comprises an elastic element connected to the lower baffle and the rotatable connecting element respectively.

3. The screen printing device of claim 2, wherein the elastic element is one of a spring and an elastic band.

4. The screen printing device of claim 1, further comprising a sliding element located on an end of the adjusting element away from the rotatable connecting element.

5. The screen printing device of claim 4, wherein the sliding element is one of a pellet and a bearing.

6. The screen printing device of claim 1, further comprising two side baffles located apart from each other between the lower baffle and the blade.

7. The screen printing device of claim 1, wherein the lower baffle defines a recess therein facing the blade.

8. The screen printing device of claim 1, wherein the blade is made of aluminum and silica gel.

9. The screen printing device of claim 1, further comprising a reinforcing element interconnecting the lower baffle and the adjusting element.

10. The screen printing device of claim 1, wherein the rotatable connecting element is connected to the lower baffle at a middle portion of the lower baffle.

* * * * *